United States Patent [19]

Moeller

[11] 3,973,368

[45] Aug. 10, 1976

[54] CEILING TILE ASSEMBLY

[76] Inventor: Wolfgang W. Moeller, 4 Glen Cove Drive, Glen Head, N.Y. 11545

[22] Filed: Dec. 23, 1974

[21] Appl. No.: 535,863

[52] U.S. Cl. ..... 52/476; 52/484; 52/632

[51] Int. Cl.[2] ..... E04B 5/52

[58] Field of Search ..... 52/632, 483, 484, 486, 52/489, 476; 49/463

[56] References Cited

UNITED STATES PATENTS

| | | | |
|---|---|---|---|
| 1,789,827 | 1/1931 | McKay | 52/484 |
| 1,998,423 | 4/1935 | Stubbs | 52/483 |
| 2,070,150 | 2/1937 | Venzie | 52/484 |
| 2,318,092 | 5/1943 | Olsen | 52/484 |
| 2,670,919 | 3/1954 | Esoldi | 52/632 |
| 2,999,278 | 9/1961 | Spencer | 52/484 |
| 3,035,672 | 5/1962 | Tuten | 52/484 |
| 3,315,074 | 4/1967 | Buzan | 52/476 |
| 3,333,387 | 8/1967 | Deakins | 52/484 |
| 3,475,869 | 11/1969 | Jahn | 52/484 |
| 3,589,086 | 6/1971 | Schilling | 52/484 |
| 3,693,303 | 9/1972 | Downing | 52/476 |
| 3,862,530 | 1/1975 | Martine | 52/489 |

FOREIGN PATENTS OR APPLICATIONS

| | | | |
|---|---|---|---|
| 1,213,772 | 4/1960 | France | 52/484 |
| 1,340,294 | 9/1963 | France | 52/484 |
| 1,055,793 | 4/1959 | Germany | 52/488 |

*Primary Examiner*—Ernest R. Purser
*Assistant Examiner*—Henry Raduazo
*Attorney, Agent, or Firm*—Burgess, Dinklage & Sprung

[57] ABSTRACT

An improvement in a modular ceiling tile assembly having a zone occupied by ceiling tile having a curf in at least one side thereof, said zone defined by ceiling tile main runners interconnected by cross members, said cross members having a generally horizontal lip protruding toward said zone, the improvement residing in that at least one of said tiles is engaged by a spline having a generally horizontal base and a generally vertical riser attached to said base, said spline being slotted, said spline being removably connected at at least one end thereof to the generally horizontal lip of a cross member by a movable clip, said clip being disposable over said horizontal lip of said cross member to rest thereon.

9 Claims, 18 Drawing Figures

CEILING TILE ASSEMBLY

CROSS REFERENCE TO RELATED APPLICATION

This is a continuation-in-part of copending application Ser. No. 392,408 filed Aug. 30, 1973 entitled Unitary Device for Joining Removable Ceiling Tile to Hanger Members, now U.S. Pat No. 3,875,717, of which Ser. No. 516,843 filed Oct. 21, 1974 is a divisional application.

BACKGROUND OF THE INVENTION

1. Field of the Invention

This invention relates to modular ceiling tile assembly. More particularly, this invention relates to a novel apparatus for connecting standard ceiling tile of the commercial type to a modular ceiling tile grid system whereby the tiles can be readily removed from the grid system without damaging the tiles and without necessitating removal of a large number of tiles. This invention is particularly directed to a spline for engaging a pair of ceiling tiles to support them between opposed cross members.

DISCUSSION OF THE PRIOR ART

In the construction of office buildings and the like, it has become the practice to employ dropped ceilings whereby the zone between the structural floor above and the apparent ceiling is occupied by the various systems of the building. In this zone are found plumbing lines, electric lines and especially heating and air conditioning ducts. This space is therefore used for accomodating all of those funtionally necessary items in a building. By using such a construction a building can be constructed where the interior partition walls can be readily changed to suit the demands of a particular tenant and to facilitate sub-division of floor space between various tenants. To this end modular ceiling tile assemblies have been provided which permit the removal of ceiling tile from the dropped ceiling to permit access to the electric lines, air conditioning ducts and the like disposed between the structural ceiling above and the dropped ceiling. Oftentimes, building maintenance men must have access to the air conditioning ducts, heating lines and electric lines in this zone. It is therefore necessary that the ceiling tiles be connected in an apparently permanent manner but be readily removable.

It is known to dipose the ceiling tiles to a modular ceiling tile assembly grid and to provide for their removal. In fact, systems have already been provided whereby removable tabs which interconnect with the tiles are not required. For instance, it is nown to snap the tiles in place by use of a special type of grid system having receiving means which engage bayonet type members on a spline which engages the cieling tile. However, such an assembly requires special construction of the main runners and cross members of the modular ceiling tile assembly. Additionally, removal of such tiles to permit access to the space above invariably damages the ceiling tile.

It has, therefore, become desirable to provide a system wherein the ceiling tile can be readily removed. More especially, it has become desirable to provide a system whereby only a few tiles need be removed at a single instance, thereby overcoming problems heretofore encountered where a minimum of four tiles had to be removed during a single removal operation. In removing four or more tiles, damage invariably occurs because of the tendency of the tiles to drop funnel-like at the same instance. Such presented problems for the maintenance men who could not cope with the four tiles descending at the same time.

It is also an object of the invention to provide a spline for use in supporting ceiling tile between cross members of a modular ceiling tile grid system which can be assembled at little cost, can readily be engaged for purpose of removal from the assembly and can engage a horizontal lip of a cross member to rest thereon.

These and other objects of the present invention will become apparent from the ensuing disclosure.

SUMMARY OF THE INVENTION

Broadly, this invention contemplates an improvement in a modular ceiling tile assembly having a zone occupied by ceiling tile having a curf in at least one side thereof, said zone defined by ceiling tile main runners interconnected by cross members, said cross members having a generally horizontal lip protruding toward said zone, the improvement residing in that at least one of said tiles is engaged by a spline having a generally horizontal base and a generally vertical riser attached to said base, said spline being slotted, said spline being removably connected at at least one end thereof to the generally horizontal lip of a cross member by a movable clip, said clip being disposed over said lip on said cross member to rest thereon.

Generally speaking, the spline and clip assembly of the present invention is used to support ceiling tile in a grid system defined by a pair of generally parallel main runners having inwardly directed horizontal lips, said main runners interconnected by generally parallel cross members also having inwardly directed horizontal lips. The zone defined by such grid system accommodates a plurality of ceiling tiles along the length of a main runner between opposed cross members. This plurality of ceiling tiles are supported between the cross members by a common spline engaging the plurality of ceiling tiles and being removably interconnected to the opposed horizontal lips of cross members by a pair of clips of the type described above, one of which clips is disposed at one end of said spline and rests over a horizontal lip of a cross member and the other of said clips being connected to the opposed end of said spline and resting over the horizontal lip of the opposed member.

The present invention contemplates in particular a spline which is slotted at a plurality of points along its length. Preferably, the spline is slotted proximate each end thereof, say, between 0.5 and 5 cm from each end. While various shaped splines are contemplated, there is particularly contemplated splines having an L and inverted T cross section. Of these, a spline having an L shapeed cross section wherein the vertical riser of the L is inclined toward the horizontal base to define an angle of between 5° and 45° is particularly preferred.

The clips which engage upon the horizontal lips of cross members can be of any of a number of configurations. A particularly contemplated clip is one having a generally vertical member connected to the end of the spline which at its apex has angularly dependent therefrom and in generally facing relationship therewith a resilient yieldable member having a terminal arcuate edge, which arcuate edge terminates in the direction of the vertical member. In use of such a clip, the terminal arcuate edges rests upon a horizontal lip of a cross member such that when a force is applied against the spline connected to said clip, the resilient portion of the clip will move toward the vertical member, thereby allowing the resilient member to slide along the edge of the horizontal lip of the cross member permitting removal of the spline at the cross member. This will be explained in greater detail below.

Another particularly contemplated clip is one which comprises a reciprocably slidable member which overlies the horizontal base of the spline at the region of the slotting. A tool can be passed through the slot of the spline to engage the reciprocably slidable member and to slide the same outwardly over the edge of the spline to rest upon the horizontal lip of a cross member. Such a clip can be sized to conform to the shape of the spline whereby it slides across the contour of the spline. In such an instance, a track or other retaining means is provided on the generally vertical portion of the spline to retain the clip so that it does not move laterally away from the spline. This track can also assist in the reciprocal slidable movement of the clip over the end of the spline and over the horizontal lip of the cross member.

DESCRIPTION OF DRAWINGS

The present invention can be more readily understood and appreciated when reference is made to the accompanying drawings in which:

FIG. 4 also shows the manner in which a removing tool engages the spline to remove the same from interengagement with the horizontal lip of the cross member;

DESCRIPTION OF PREFERRED EMBODIMENTS

Figure 1:
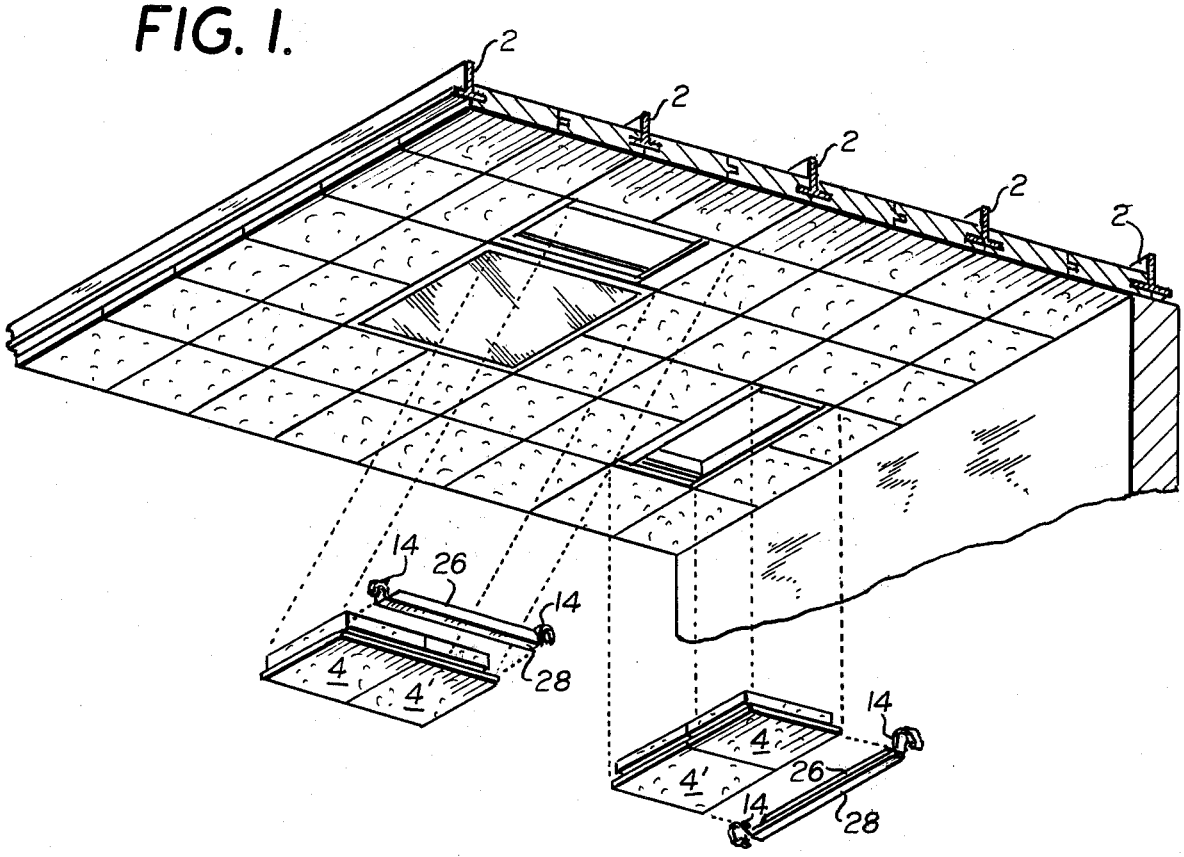
FIG. 1 is a perspective view, partially exploded, of a dropped ceiling of a modular ceiling tile construction showing the removal of a section of ceiling tile comprising only two separate ceiling tiles.
Figure 2:
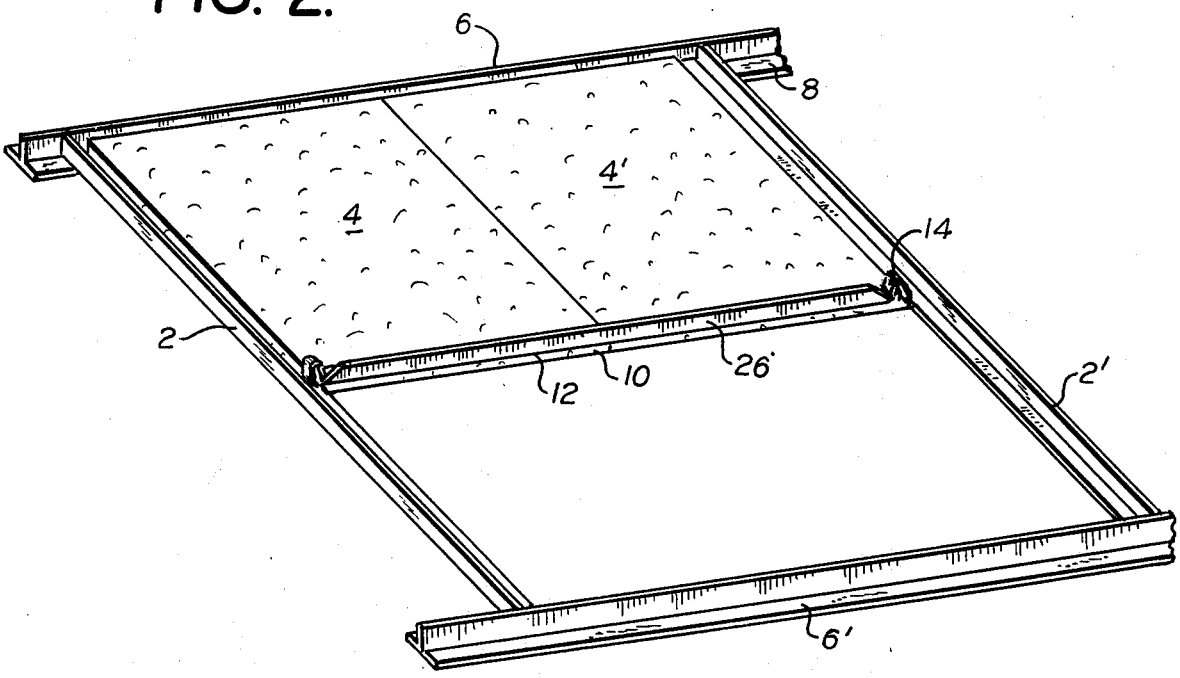
FIG. 2 is a perspective view from above showing the disposition of a pair of ceiling tiles by the use of a common spline which engages opposed generally parallel running cross members by a pair of clips.

Referring to the drawings herein, the spline of the invention is used to support ceiling tile in a modular ceiling tile assembly defined by a pair of generally parallel running main runners interconnected by generally parallel running cross members. In this connection, it should be understood that in this assembly the main runners provide an inwardly directed horizontal lip in the same manner in which the cross members provide such a lip. Therefore, as will be seen below, it does not make any difference whether a given support member be dominated a main runner or a cross member, for in the assembly of the invention, they perform an identical function. Referring to FIG. 1, there is shown cross members 2 running generally parallel with one another. These cross members are connected at periodic intervals to main runners not shown in FIG. 1. The grid system defined by the main runners and cross members is held, according to local building codes, by structural members dependent from the structural ceiling thereabove. In FIG. 1 there is shown the method by which a pair of ceiling tiles can be removed from the assembly. The removal operation will be understood after a detailed description of the manner by which the ceiling tiles are removably connected to this system. In FIG. 2 there is shown the engagemment of ceiling tiles 4 and 4' between main runners 6 and cross members 2. The main runner 6 is shown to have an inverted T cross section, but such inverted shape is not necessary. All that main runner 6 need have is a horizontal surface 8 which will engage the ceiling tiles 4 and 4'. Generally, ceiling tiles 4 and 4' are provided with a curf (not shown) through which the horizontal member 8 passes. A portion of the ceiling tiles 4 and 4' is disposed beneath the horizontal member 8 so that no portion of the main runner 6 is readily visible to the naked eye from below.

Disposed between cross member 2 and 2' there is provided a spline of the invention, which spline is disposed within a curf 12 within the side 10 of ceiling tiles 4 and 4'. This spline extends along virtually the entire width of ceiling tiles 4 and 4' and has at either terminal edge thereof a clip better shown in FIGS. 3 and 4. This clip member compirses a generally vertical member 14 which at its apex 16 terminates in an angularly dependent member 18 which in turn has an inwardly directed arcuate member 20 which can rest upon the horizontal lip 22 of a cross member 2 as shown in FIG. 4.

The spline preferably has a generally vertical member 26 which rises from one edge of a base 28. Base 28 is slotted proximate vertical riser 26 with slots 30 and 32, although the number of such slots need only be one. Preferably, a plurality of such slots is provided. Generally, there is at least one slot at either end of the spline.

Figure 5:
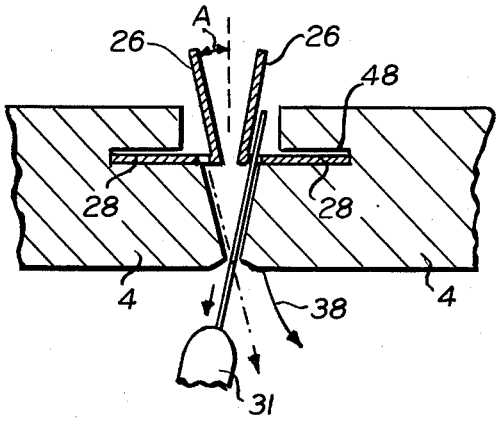
FIG. 5 is a cross sectional view taken along the line 5—5 of FIG. 4.

As shown in FIG. 5, the generally vertical member 26 is inclined toward the horizontal base 28 to define an angle A. This angle A is between 5° and 45°. By use of such an angle the tiles 4 and 4' can be removed from tiles disposed toward the opposed main runner without any damage during the removal operation.

Figure 4:
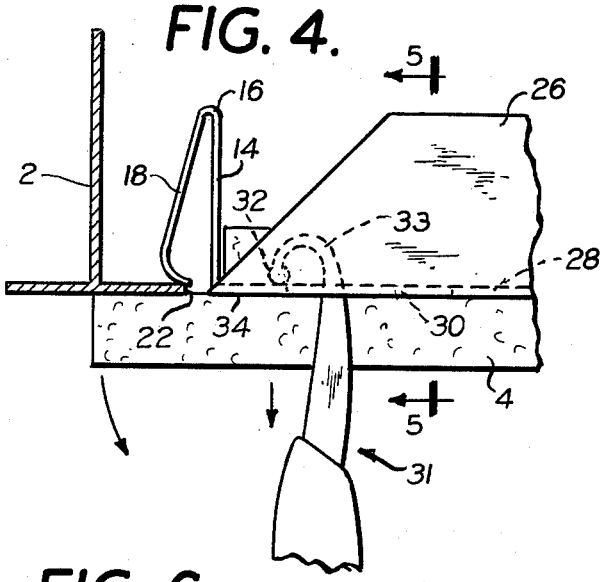
FIG. 4 is a side view showing the engagement of the clip connected to the spline on a horizontal lip of a cross member.

With respect to the removal operation, the tiles 4 and 4' of FIG. 2 are removed by disposing a tool 31 having a protruding arcuate end 33, which tool can pass through a slot 30, as shown in FIG. 4, to overlie an edge 34 of the spline. When the tool 30 has its arecuate end in engagement with the portion 34 of the spline, a downward movement of the tool 31 can commence. A downward force will cause the arcuate end 20 of the clip to bear against the edge of horizontal lip 22 and to act cam-like, whereby permitting removal of the entire angularly dependent member 18. By inclining the generally vertical riser 26 towards the base member, no damage to adjoning ceiling tile will occur. As shown in FIG. 5, engagement on the tool 31 will cause the tile to drop and pass along an arcuate path as shown by arrow 38. Since the generally vertical member 26 is inclined toward base 28, it will clear the tile 4 to the left thereof, thereby avoiding any problem of damage to the tile.

Referring to FIG. 2, it will be appreciated that by using a spline having an L-shaped cross section one can remove tiles 4 and 4' without removing tiles disposed between the spline and the opposed main runner 6. What this means is that by such a construction, only two tiles need be removed. In removing tiles, a mechanic can readily remove two tiles without any damage, because two tiles present no problem in handling. Were it necessary to remove four tiles at the same time, damage might ensue owing to the inability of the mechanic to cope with the four tiles descending at the same time.

Figure 6:
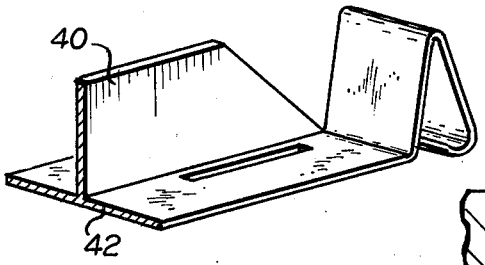
FIG. 6 is a perspective view of another spline of the invention having an inverted T cross section, the spline having connected at a terminal edge thereof a clip of the type shown in FIGS. 3 and 4.

Another embodiment of the invention is shown in FIG. 6 wherein the spline has a generally inverted T shape. In this instance the spline is employed generally to engage tiles disposed on either side thereof, and normally the spline will be used to connect four tiles to a given grid system. In such an instance, the vertical member 40 rises off the base member 42 to define an angle between the vertical riser 40 and the base 42 of 90°. Again, the spline is slotted proximate its end and has connected thereto a clip as described above. In the use of such an inverted T-shaped spline, the tool 31 is passed through a slot on either side of the vertical riser 40 and is caused to engage the surface of the spline. A downward movement will effect removal of the spline from the cross members, thereby removing all of the tiles which are connected to the spline. As in FIG. 5, the horizontal member of the spline engages the curf 48 of the tile. These curfs are generally provided in the ceiling tiles at the point of their manufacture. Thus, it is a simple matter to place the ceiling tiles over the horizontal members 42 or 28, as the case may be, and to snap the splines in place by the use of the clip member. It should be understood that the L-shaped spline is particularly desirable because one can readily remove two tiles. It is particularly contemplated to use back-to-back or mirror image splines as shown in FIG. 5, whereby either pair of ceiling tiles can be removed independently from one another.

Figure 3:
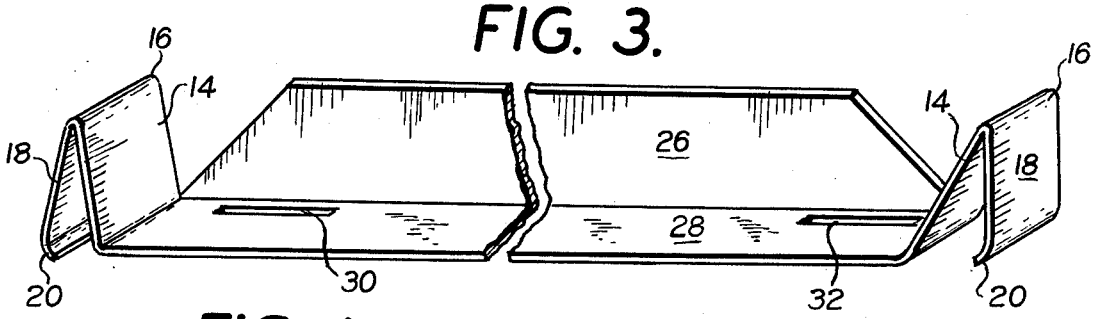
FIG. 3 is an enlarged view of the spline shown in FIG. 2, the spline having a generally L-shaped cross section. The spline of FIG. 3 is enlarged from that of FIG. 2.
Figure 7:
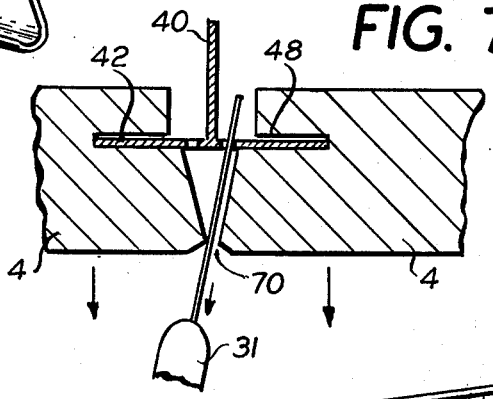
FIG. 7 shows the method by which the spline of FIG. 6 is used to engage ceiling tile, this view being similar to the view of FIG. 5.
Figure 8:
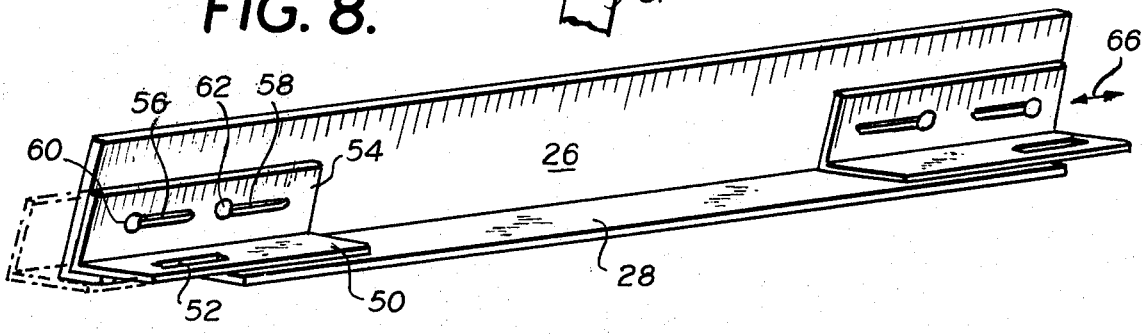
FIG. 8 is a perspective view of a spline of the invention having a generally L-shaped cross section provided with a clip other than the type shown in FIGS. 3, 4 and 6.

A particularly contemplated clip of the invention is shown in FIG. 8. In FIG. 8 the clip is shown disposed on an L-shaped spline although it should be understood that the clip can be disposed in back-to-back fashion on a T-shaped spline of the type shown in FIGS. 6 and 7. The clip of FIG. 8 has a generally planar member 50 which slidably rides over the horizontal base 28 of the spline. The clip is itself provided with a slot 52, which slot is generally of a size smaller than slots 30 and 32. It is not necessary that the slot 52 pass through the entire thickness of the clip. All that is required is that there be some surface of the clip for engagement with a tool such as tool 31. Desirably, the clip of FIG. 3 is engaged to the generally vertical member 26 by retaining means which restrain the clip from moving other than in a direction reciprocally towards and away from the cross members. Stated differently, movement of the clip towards the ceiling tile is prohibited. In the embodiment of FIG. 8 this track is provided by slotting the vertical poriton 54 of the clip with slots 56 and 58. Within these slots are pin members having head 60 and 62 which overlie the slots and restrain movement of the clip toward the ceiling tile. The head 60 and 62 do not bear against the vertical portion 54 of the clip to such an extent as to preclude the reciprocal motion depicted in FIG. 8 by the reciprocating arrow 66.

In the assembly of the invention it is desired that the ceiling tiles be slightly beveled in the region wherein they underlie the slot so as to accommodate the tool 31. This slight beveling which is normally hardly visible to the naked eye is shown in the enlarged view of FIGS. 5 and 7 by virtue of reference number 70. Again, it should be understood that the beveling is only provided at the poriton of the edge of the tile in facing relationship with an edge of an adjacent tile and only at that portion where the edge of the tile underlies the slot of the spline.

The system of the present invention allows for the removal of only a pair of ceiling tiles, and it also allows for the ceiling tile to be removed without damage to ceiling tile of an adjacent course. Morever, the splines can be employed in known modular ceiling tile construction employing L- and inverted T-shaped main runners and cross members. The means by which the splines are connected to the main runners or cross members is by virtue of a clip which is conveniently disposed above the horizontal lip of the main runner or cross member, as the case may be, but can be conveniently removed by the use of a slot in the horizontal surface of the main runner. Means are provided to insure that during the removal operation, no damage occurs to adjacent tile.

It will be appreciated that in the foregoing description, the reference to the disposition of the tiles on a common spline between opposed cross members is illustrative. Thus, referring to FIG. 2, the assembly of tiles 4 and 4' can take place by disposing tiles 4 and 4' adjacent one another between main runners 6 and 6' whereby the spline would be turned 90° so as to run parallel to the cross members 2 and 2'. In many instances this construction is done particularly at terminal edges or walls or the like or in regions where there are ceiling fixtures. The purpose behind the entire assembly is to provide for maximum access to the region above the ceiling tiles, and such is accomplished by appropriate arrangement of the ceiling tiles and the supporting splines. Obviously, the spline assembly of the present invention allows for total access to all of the area above a dropped ceiling and without any special construction. In fact, the raw materials of the present invention are already generally available.

It will be appreciated that the device of the present invention is susceptible to numerous modifications. One of skill in the art will realize that various means for disposing the clip in resting relationship over the horizontal lip of the main runner or cross member can be provided, the present invention depicting only two specific means. For instance, there can be provided an assembly of the type shown on a garage door whereby engagement by virtue of a tool such as tool 31 centrally across the spline effects a circular movement which disposes rods connected thereto over the protruding horizontal lips of opposed cross members or main runners. Other means whereby a clip member is inserted over the horizontal lip can be also employed.

Figure 9:
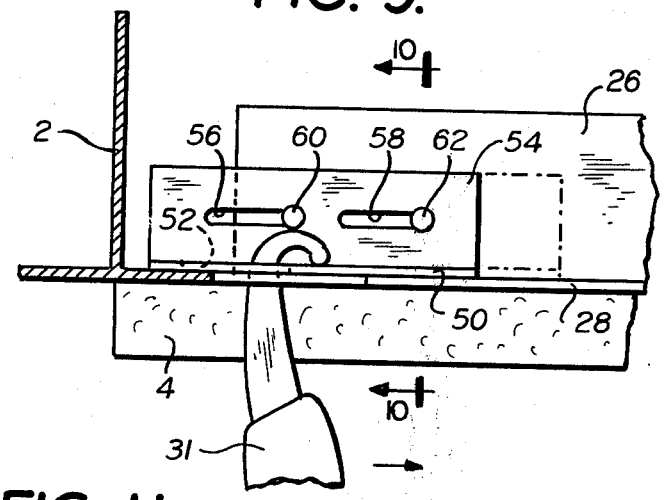
FIG. 9 is a cross sectional view showing the manner by which the clip of FIG. 8 is closed over a horizontal lip of a cross member.
Figure 10:
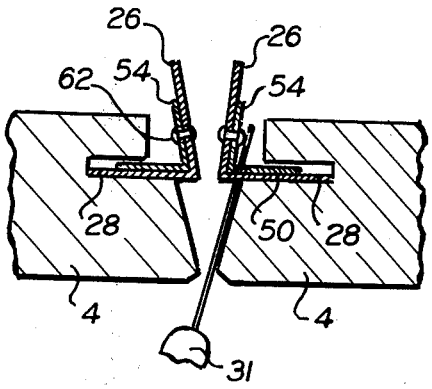
FIG. 10 is a sectional view along the line 10—10 of FIG. 9.
Figure 11:
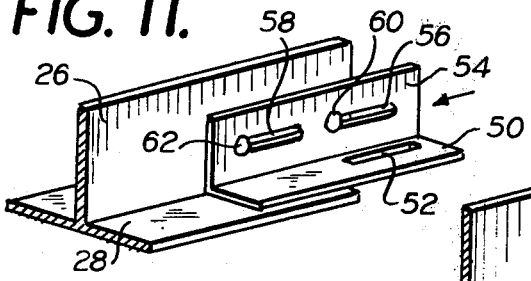
FIG. 11 is a perspective view showing the clip of FIG. 8 employed on an inverted T-shaped spline.

In FIG. 9 there is shown the engagement of the tool 31 in the slot of the clip whereby the arcuate end 33 engages a slot of a smaller size in the horizontal portion of the clip whereby to permit movement laterally of the vertical portion of the clip within the slot provided over which lies a rivet head. The assembly of FIG. 9 is shown with greater particularlity in FIG. 10 wherein back-to-back generally L-shaped spline members are employed each of which contains a generally L-shaped clip rideable along the surface of the vertical riser 26 of the spline through use of the slots shown in FIG. 9 through which the rivets pass. Engagement of the tool 31 with these slots is shown in FIG. 10. FIG. 11 shows the manner by which the L-shaped clip can be employed on a spline having a generally inverted T shape.

Figure 12:
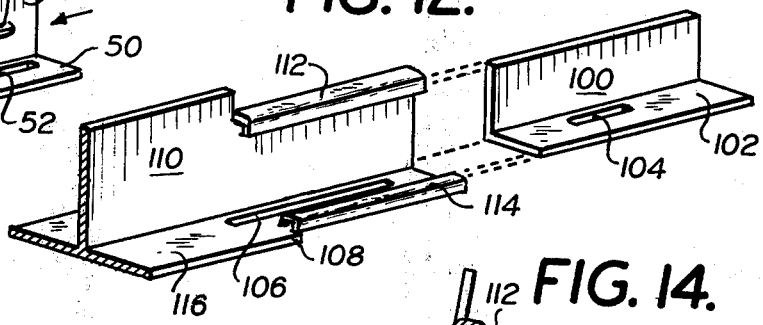
FIG. 12 is another embodiment of the invention in which a generally L-shaped clip is disposed in a track defined by U-shaped track members.
Figure 13:
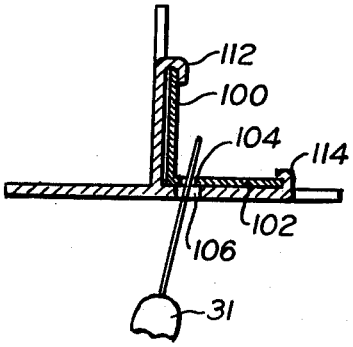
FIG. 13 is a view showing the disposition of the clip of FIG. 12 over the horizontal lip of a cross member.
Figure 14:
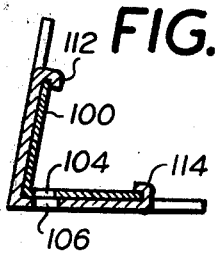
FIG. 14 is a view similar to FIG. 13 showing the clip in a spline having a generally L-shaped cross section whereas in FIG. 13 the clip is in a spline having an inverted T-shaped cross section.

Referring to FIG. 12, another clip having a vertical riser 100 connected to an edge of a horizontal portion 102 slotted at 104 is provided. Slot 104 has a length smaller than slot 106 of horizontal base 108 of the spline. The vertical poriton 100 of the clip is retained against the vertical riser 110 of the spline by use of a retainer track having an inverted T shape as shown at reference numeral 112, this track having a downwardly protruding edge which overlies a portion of vertical member 100 as shown in the phantom drawing of FIG. 12. Similarly, there is provided an L-shaped track 114 disposed on an outer edge of horizontal base 116 which overlies a horizontal outer edge of the horizontal member 102 of the clip. Movement of the clip reciprocably is demonstrated in FIG. 13 wherein the tool 31 or other appropriate tool passes through the slot 106 of the horizontal base of the spline and engages the horizontal member 102 of the clip by passage through a smaller slot 104. The same type of arrangement is shown in FIG. 14 in respect of a generally L-shaped spline. In both of these views, the vertical riser 100 of the clip is restrained within tracks 112 on the vertical riser 110 of the spline and within horizontally disposed tracks 114 which overlie horizontal member 116. Engagement of the member 102 of the clip is the same in FIG. 14 as it is in FIG. 13.

Figure 15:
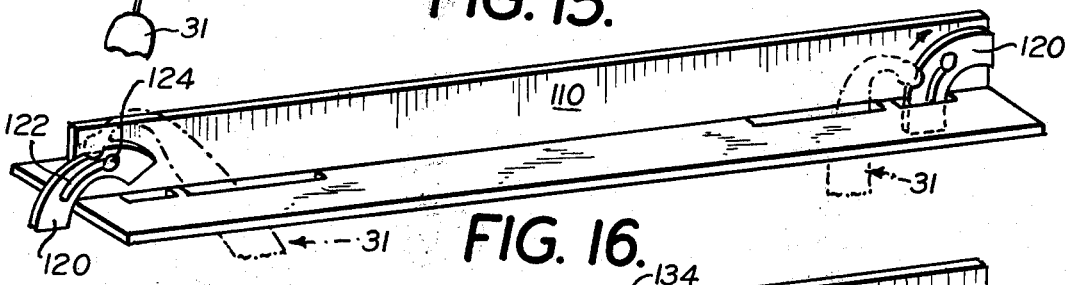
FIG. 15 is a perspectivew view of another embodiment of the invention wherein on either end of the spline there is an arcuately shaped member rideable on a track which can be engaged by a member 32 so as to pivot over and rest upon a horizontal lip of a cross member.

The clip of FIG. 15 is one which is arcuate rotatable. To this end there is provided a quadro-circular member 110 slotted at 122 and maintained to spline vertical riser 110 by the use of a rivet head 124 which overlies an exterior edge of quadro-circular member 120 whereby the member 120 can be swung over the horizontal lip of a cross member and still ride on the rivet head 124. In FIG. 15 the tool 31 having a terminal hook 33 has engaged the clip 120 as shown at the left thereof, whereas at the right of FIG. 15 the disposition of tool 31 and hook 33 are shown before engagement with the clip 120.

Figure 16:
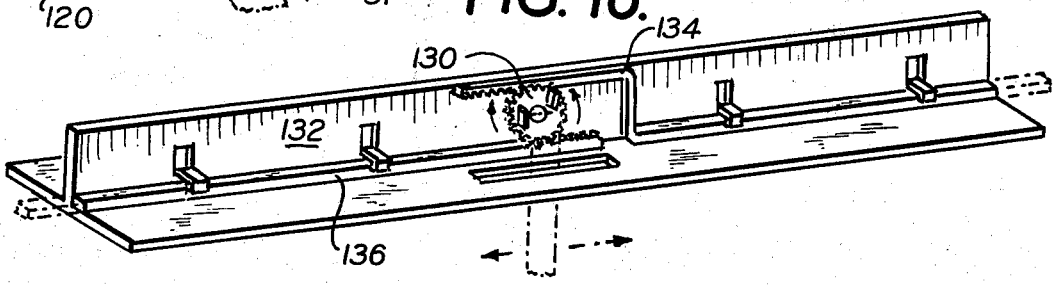
FIG. 16 is a perspectivew view of still another clip member wherein revolution of a circular shaped gear moves rods so as to overlie push rods on a horizontal clip.

FIG. 16 is directed to another embodiment of the invention. In FIG. 16 a sprocketed wheel 130 pivotally mounted to the vertical riser 132 of the spline engages at either end thereof sprocketed rods 134 and 136. Revolution of sprocketed wheel 130 causes the rods 134 and 136 to move reciprocally along the length of the spline. Depending upon whether the revolution of the sprocketed member 130 is clockwise or counterclockwise, the rods 134 and 136 will move outwardly to overlie the horizontal lip of a cross member or retractably so as not to overlie the same. In FIG. 16, the phantom position of the rods 134 and 136 represents the position of rods 134 and 136 when the sprocketed wheel 130 has been rotated about 90°.

Figure 17:
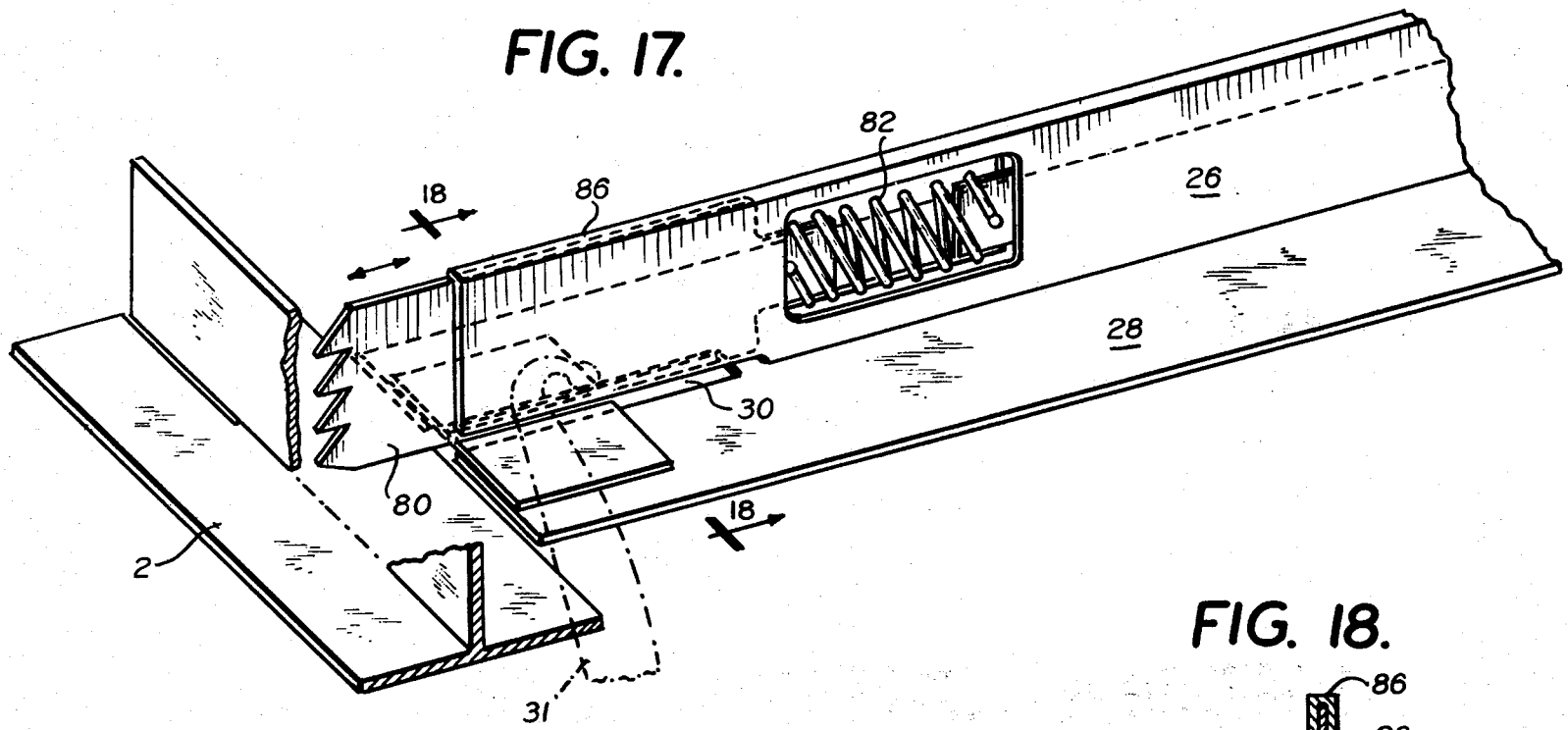
FIG. 17 is a perspective view showing still another clip which can be disposed over the horizontal lip of a cross member.
Figure 18:
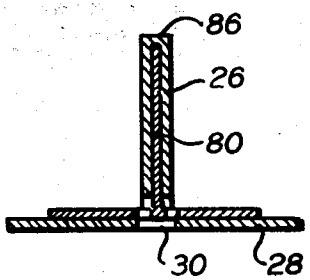
FIG. 18 is a cross sectional view taken along the line 18—18 of FIG. 17.

Another embodiment of a clip is depicted in FIG. 17 wherein there is a reciprocatable vertical member 80 disposed within the vertical riser 26. Suitably, the vertical member 80 is attached to a coil spring 82 positioned within the riser 26 extending in a lateral direction toward the horizontal lip of a cross member.

By use of a tool 31, the vertical member 80 can be engaged, the tool 31 passing through a slot 30 of the spline to engage a suitable indent within the body of the vertical member 80. Naturally, the upper surface 86 of the vertical member 80 should be strong enough to hold the spline since pressure will develop on that upper surface. This assembly is particularly useful where the spline has an inverted T shape, although the same can also be employed where the spline has an L-shaped cross section and even in those instances where the vertical member 26 is inclined toward the base 28.

The terms and expressions used herein have been used as terms and expressions of illustration and not of limitation, as there is no intention, in the use of such terms and expressions, to exclude equivalents or portions thereof, as various modifications and departures will become apparent to one of skill in the art from the above disclosure.

What is claimed is:

1. In a modular ceiling tile assembly having a zone occupied by ceiling tile having a curf in at least one side thereof, said zone defined by ceiling tile main runners interconnected by cross members, said cross members having a generally horizontal lip protruding towward said zone, the improvement wherein a first tile is juxtaposed to a second tile, said first tile supported by the horizontal base of a first spline, said second tile supported by a horizontal base of a first spline, said second tile supported by a horizontal base of a second spline, said first spline and said second spline running parallel to one another, each of said splines having a generally vertical riser attached to a generally horizontal base, said splines being removably connected at at least one end thereof to a generally horizontal lip of a cross member by a movable clip, said clip being disposable over said horizontal lip of said cross member to rest thereon, the vertical riser of said first spline being positioned back-to-back the vertical riser of said second spline, each of said vertical risers being inclined angularly toward its base to define an angle between 85° and 45°C, each of said splines being slotted.

2. A modular ceiling tile assembly according to claim 1 wherein at least one of said splines has on at least one end thereof a resilient clip, which clip comprises an upwardly extending vertical member which terminates in an angularly descending member, which descending member has connected thereto a resilient arcuate member which faces said upwardly extending vertical member and engages an edge of a horizontal lip of a cross member whereby when a vertical force is exerted on said spline said arcuate member deforms toward said upwardly extending vertical member to disengage said spline from said horizontal lip.

3. In a modular ceiling tile assembly having a zone occupied by a ceiling tile having a curf in at least one side thereof, said zone defined by ceiling tile main runners interconnected by cross member, said cross members having a generally horizontal lip protruding toward said zone, the improvement wherein at least one of said tiles is engaged by a removable spline having a generally horizontal base and a generally vertical riser attached to said base, said spline being slotted, said spline being removably connected at at least one edge thereof to a generally horiziontal lip of a cross member by a movable clip formed integral with said spline and removable therewith, said clip being disposed over said horizontal lip of said cross member to rest thereon, said clip consisting essentially of a generally flat resilient sheet having an upwardly extending portion which rises from said spline at its edge thereof and uninterruptingly angularly descends toward said horizontal lip and terminates in an arcuately shaped resilient end member which faces said upwardly extending portion and engages the edge of said horizontal lip of a cross member whereby when a vertical force is exerted on said spline said arcuate member deforms owing to the resilient nature of the generally flat sheet material toward said upwardly extending portion to disengage said spline and said clip, from said horizontal lip.

4. A modular ceiling tile assembly according to claim 3 wherein said clip is entirely disposed in the free vertical space disposed between the edge of said horizontal member and said generally horizontal lip.

5. In a modular ceiling tile assembly having a zone occupied by ceiling tile having a curf in at least one side thereof, said zone defined by ceiling tile main runners interconnected by cross members, said cross members having a generally horizontal lip protruding toward said zone, the improvement wherein at least one of said tiles is engaged by a spline having a generally horizontal base and a generally vertical riser attached to said base, said spline being slotted, said spline being removably connected at at least one end thereof to a generally horizontal lip of a cross member by a movable clip, said clip being disposable over said horizontal lip of said cross member to rest thereon, said clip comprising an arcuately rotatable member having an arcuate slot therein, said vertical riser having a pin and said arcuately rotatable member being engaged by said pin which passes into said arcuate slot.

6. A modular ceiling tile assembly according to claim 5 wherein said horizontal base of said clip has a slot running along the length of said vertical rider, which slot has a length at least equal to the width of said arcuately rotatable member.

7. In a modular ceiling tile assembly having a zone occupied by ceiling tile having a curf in at least one side thereof, said zone defined by ceiling tile main runners interconnected by cross members, said cross members having a generally horizontal lip protruding toward said zone, the improvement wherein at least one of said tiles is engaged by a spline having a generally horizontal base and a generally vertical riser attached to said base, said spline being slotted, said spline being removably connected at at least one end thereof to a generally horizontal lip of a cross member by a movable clip, said clip being disposable over said horizontal lip of said cross member to rest thereon, said spline having a pair of horizontally movable clips in the form of bars, one at each end thereof, said clips being mounted within guide means, each of said bars having a rack member integral therewith at its end opposite the horizontal lip of the cross member, the rack of one of said bars facing the rack of the other bar, said racks engaged by a common gear whereby rotation of said gear moves said racks toward one another or away from one another depending upon the direction of rotation.

8. In a modular ceiling tile assembly having a zone occupied by a ceiling tile having a curf on at least one side thereof, said zone defined by ceiling tile main runners interconnected by cross members, said cross members having a generally horizontal lip protruding toward said zone, the improvement wherein at least one of said tiles is engaged by a spline having a generally horizontal base and a generally vertical riser attached to said base, said spline being slotted, said spline being removably connected at at least one end thereof to a generally horizontal lip of a cross member by a movable clip, said clip being disposable over said horizontal lip of said cross member to rest thereon said clip comprising a generally vertical member rideable over a vertical portion of said spline and connected to said spline by a spring which biases the vertical member of the clip over a horizontal lip of a cross member, said vertical member of said clip being in general registry with the slot in said spline, the terminal edge of the vertical member of said clip at the cross member being serrated with vertically disposed teeth.

9. A ceiling tile assembly according to claim 1 wherein said ceiling tile is beveled at an edge portion thereof where it underlies said slot.

* * * * *

UNITED STATES PATENT AND TRADEMARK OFFICE

CERTIFICATE OF CORRECTION

PATENT NO. : 3,973,368

DATED : August 10, 1976

INVENTOR(S) : Wolfgang W. Moeller

It is certified that error appears in the above-identified patent and that said Letters Patent are hereby corrected as shown below:

Column 1, line 56, change "cieling" to --ceiling--.

Column 4, line 5, change "perspectivew" to --perspective--.

Column 6, line 15, change "FIG. 3" to --FIG. 8--;

line 36, change "poriton" to --portion--.

Column 7, line 39, change "poriton" to --portion--.

Column 8, line 49, change "towward" to --toward--.

Signed and Sealed this

Fifteenth Day of February 1977

[SEAL]

*Attest:*

RUTH C. MASON
*Attesting Officer*

C. MARSHALL DANN
*Commissioner of Patents and Trademarks*